United States Patent [19]

Reith

[11] Patent Number: 4,590,099

[45] Date of Patent: May 20, 1986

[54] FIBROUS WEB SATURATOR

[75] Inventor: Richard A. Reith, Memphis, Tenn.

[73] Assignee: R & R Research & Development, Inc., Memphis, Tenn.

[21] Appl. No.: 660,026

[22] Filed: Oct. 12, 1984

[51] Int. Cl.[4] ..... B05D 3/00; B05D 3/12; B05C 3/12; B05C 11/115

[52] U.S. Cl. ..... 427/296; 118/50; 118/405; 118/424; 118/427; 427/326; 427/434.4

[58] Field of Search ..... 118/50, 427, 405, 424; 427/296, 434.4, 294, 326

[56] References Cited

U.S. PATENT DOCUMENTS

| | | | |
|---|---|---|---|
| 1,322,327 | 11/1919 | Minton | 427/298 |
| 1,595,491 | 8/1926 | Minton | 118/33 |
| 1,633,121 | 6/1927 | Minton | 34/242 |
| 2,125,364 | 8/1938 | Waldron | 118/50 |
| 3,644,137 | 2/1972 | Fox et al. | 8/151 |
| 3,826,703 | 7/1974 | Russell | 156/189 |
| 3,848,439 | 11/1974 | Lopata | 68/184 |
| 3,881,445 | 5/1975 | Nothiger | 118/663 |

*Primary Examiner*—Evan K. Lawrence

*Attorney, Agent, or Firm*—Gerald G. Crutsinger; John F. Booth; Monty L. Ross

[57] ABSTRACT

An apparatus and method to saturate a fibrous web. The apparatus comprises a sealed chamber divided to form a low pressure preparation zone and a high pressure treatment zone. Air is evacuated from the open area between the fibers in the web in the vacuum zone and liquid in the treatment zone is forced into the evacuated open area between the fibers in the web. A pair of nip rollers are submerged in liquid in the treatment zone for squeezing residual air and liquid from the open area between the fibers in the web to cause liquid to be drawn into the open area between the fibers in the web upon exiting the nip between the rollers.

5 Claims, 5 Drawing Figures

FIBROUS WEB SATURATOR

BACKGROUND OF INVENTION

The fibrous web saturator described herein relates to improvements in apparatus of the type disclosed in U.S. Pat. No. 1,595,474; U.S. Pat. No. 3,881,445; U.S. Pat. No. 3,644,137; U.S. Pat. No. 2,125,364; and U.S. Pat. No. 1,683,254 which generally disclose apparatus for vacuum treatment of fibrous web material. In the method of using the apparatus, the web is moved through a vacuum chamber to remove air which is held on the surface of the material or occluded in pores formed in the web of material. After passing from the vacuum chamber, the web is immersed in liquid in an effort to saturate the web.

Devices heretofore devised for vacuum treatment of a web moving through a vacuum chamber having encountered difficulties in sealing the chamber to permit reduction of pressure to a level sufficiently low to remove sustantially all of the air from the pores in the web so that they can be completely filled with coating material and the web saturated.

Apparatus similar to that disclosed in U.S. Pat. No. 3,881,445 has been used heretofore for applying an aqueous solution of various materials such as sodium silicate and starch to a paper web. The system, however, did not provide optimum saturation of the web at maximum web speeds.

SUMMARY OF INVENTION

The present invention relates to a fibrous web saturator and the method of using the same. The web saturator described herein generally comprises a chamber provided with seals to permit movement of a web of paper or other material through the chamber. The chamber is divided into at least two zones to form a low pressure preparation zone and a pressurized treatment zone.

Pressure in the preparation zone is reduced to form a partial vacuum to evacuate a substantial portion, for example, approximately ¾ of air from the open area between the fibers in the web. The web passes from the preparation zone through a seal into a pressurized treatment zone which is at least partially filled with liquid so that liquid will be forced into void areas in the web.

A pair of squeeze rollers are submersed in liquid in the pressurized treatment zone to form a nip through which the web is routed. As the web enters the nip between the rollers, further roll line pressure is exerted on the liquid forced into the web and any residue of air remaining in the open area between the fibers in the web.

This "kneading" action of the nip rolls in the pressurized liquid area forces the liquid which has already penetrated the surface and any residual air bubbles to move in a wave like motion causing additional wetting of internal fibers deep in the web. Occluded air bubbles which have been reduced in size due to being subjected to elevated pressure in the open areas between the fibers of the web are broken up, further reduced in size and disbursed throughout the fibers. This action is very desirous when dealing with hard to wet dense fibered papers. As pressure on the web is released when the web leaves the nip between the squeeze rollers, more liquid is again drawn into the the open area between the fibers in the web to saturate the web with the liquid.

Rollers at the exit from the treatment zone of the chamber perform a dual function of a metering apparatus for removing excess liquid from the surface of the web and form an air lock or seal to assure that a pressure differential is maintained between the treatment zone and the atmosphere outside of the chamber. As the saturated web moves from the high pressure treatment zone to atmospheric pressure outside the chamber and after passing through the metering nip the saturated web is allowed to expand at atmospheric pressure.

It will become readily apparent that the web is squeezed between rollers at four separate stages as it moves into, through and out of a chamber in the saturator. The web is first squeezed between a pair of rollers at the entrance into the chamber to initially evacuate some of the air from the open area between the fibers in the web. The web then passes into a vacuum zone to further evacuate air from the open area between the fibers and subsequently between rollers forming a seal between the vacuum zone and a pressurized treatment zone. After removal of a significant portion of the air as the web moves into, through and out of the vacuum zone in the chamber, the web is moved through pressurized liquid in the treatment zone. Squeezing the web between squeeze rollers in the treatment zone flushes liquid and substantially all of the residue of air from the the open area between the fibers in the web and results in the web becoming almost completely saturated with liquid in the treatment zone.

DESCRIPTION OF DRAWING

Drawings of a preferred embodiment of the invention are annexed hereto so that the invention may be better and more fully understood, in which.

Numeral references are employed to designate like parts throughout the various figures of the drawing.

DESCRIPTION OF A PREFERRED EMBODIMENT

Figure 1:
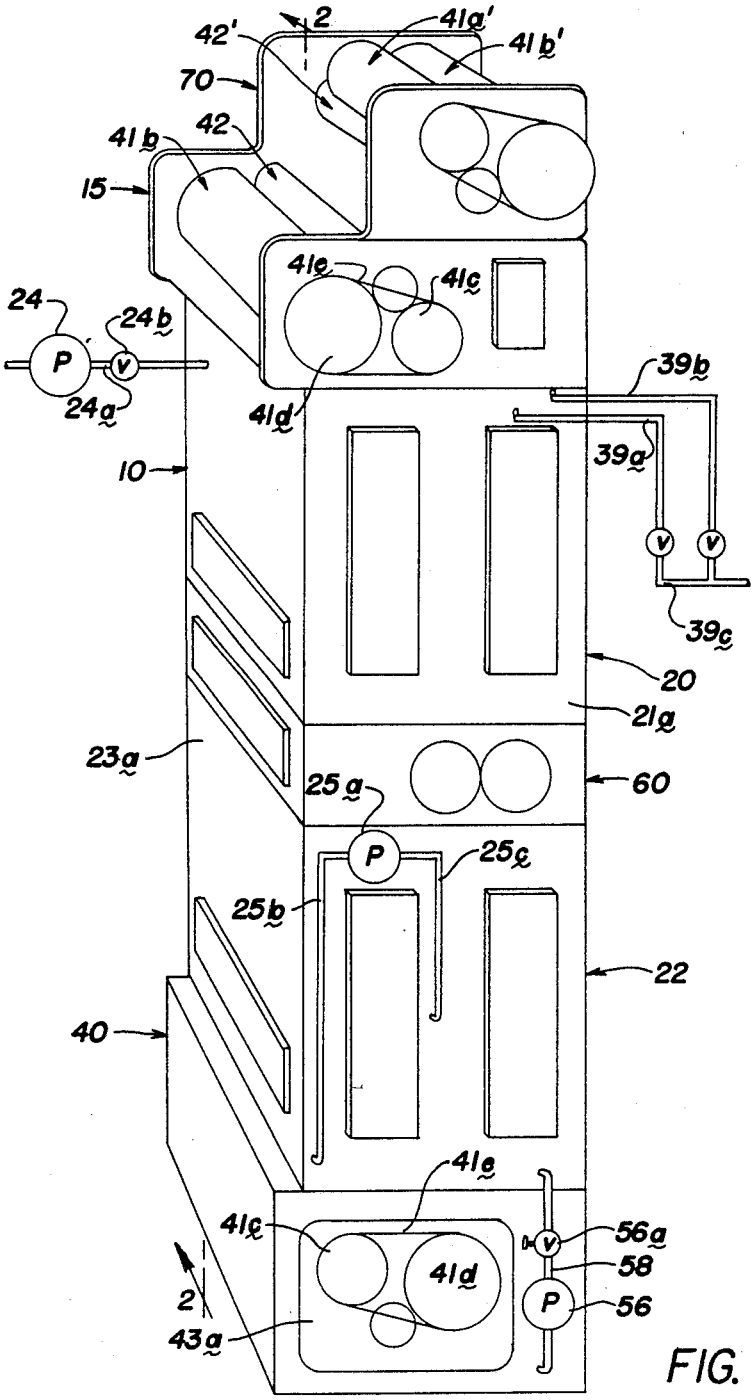
FIG. 1 is a perspective view of the web saturator.
Figure 2:
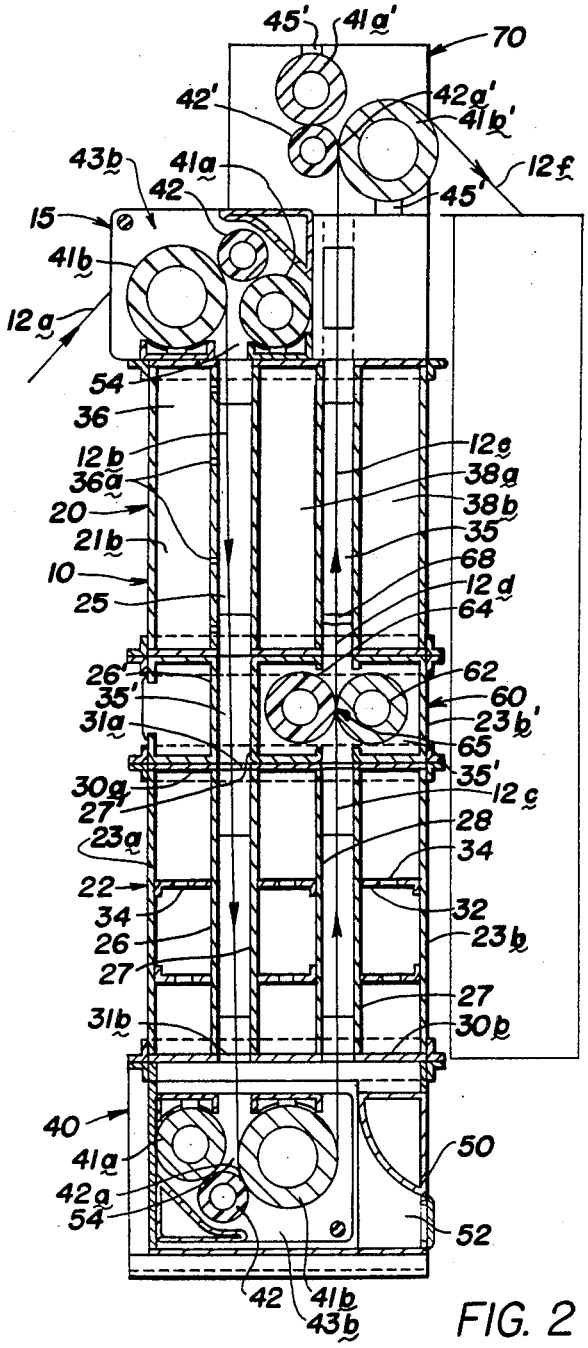
FIG. 2 is a cross sectional view taken along line 2—2 of FIG. 1.

A preferred embodiment of the web saturator is generally designated by the numberal 10 in FIGS. 1 and 2 of the drawing. A web 12, portions of which are designated as 12*a, b, c, d, e, f* at various phases of operation of the paper saturator, as shown in FIG. 2 of the drawing is routed through saturator 10 for removing air from the surface of the web and saturating the web with liquid as will be hereinafter more fully explained.

The web saturator 10 comprises an infeed vacuum seal roll unit generally designed by the numberal 15, a pair of modular sections 20 and 22, a vacuum outfeed seal roll unit 40, a squeeze roll unit 60 and an outfeed metering seal roll unit 70.

Modular sections 20 and 22 are of identical construction and each is partitioned to form a vacuum zone 25 and a treatment zone 35.

Each modular section 20 and 22 comprises spaced end walls 21*a* and 21*b*, front and rear walls 23*a* and 23*b*, and partitions 26, 27, 28 and 29 which extend generally parallel to front and rear walls 23*a* and 23*b*. Top plate 30*a* and bottom plate 30*b* having slots 31*a* for loosely accommodating passage of the web 12 therethrough, and 31*b*, respectively formed therein, are welded or otherwise secured to the walls 23*a* and 23*b* and to partitions 26, 27, 28 and 29 to form a strong rigid construction. Perforated plates 32 having spaced apertures 34 extending therethrough are welded or otherwise secured as illustrated in FIG. 2 of the drawing to provide structural reinforcing between the front and rear walls and the partitions as will hereinafter be more fully explained.

A vacuum separator tank 36 is formed between front wall 23*a* and partition 26 while a vacuum zone 25 is formed between partitions 26 and 27. Partitions 28 and 29 form treatment zone 35 between holding tanks 38*a* and 38*b* which are between partition 27 and rear wall 23*b* as best illustrated in FIG. 2 of the drawing.

As diagrammatically illustrated in FIG. 1, a gear pump 25*a* draws liquid through a line 25*b* communicating with separator tank 36 and delivers the liquid through a line 25*c* into holding tank 38*a*. A pair of air lines 39*a* and 39*b* communicate with treatment zone 35 and holding tank 38*b*, respectively. Each of the lines 39*a* and 39*b* is connected through a control valve (not shown) and line 39*c* to an air compressor or other suitable source of pressurized fluid. Each of the lines 39*a* and 39*b* is preferably provided with a check valve to prevent back flow of air or fluid from treatment zone 35 or holding tank 35*b*.

A vacuum pump 24 is connected through conduit 24*a* and valve 24*b* to the vacuum separator tank 36 for evacuating air from separator tank 36 and vacuum zone 25. As best illustrated in FIG. 2, the partition 26 between separator tank 36 and vacuum zone 25 has openings 36*a* through which vacuum zone 25 and separator tank 36 are placed in fluid communication.

SEAL ROLL UNIT

Seal roll units 15 and 40 are of substantially identical construction and as illustrated in FIG. 2 of the drawing are positioned adjacent opposite ends of vacuum zone 25 formed through one or more modular units 20 and 22.

Figures 3, 4:
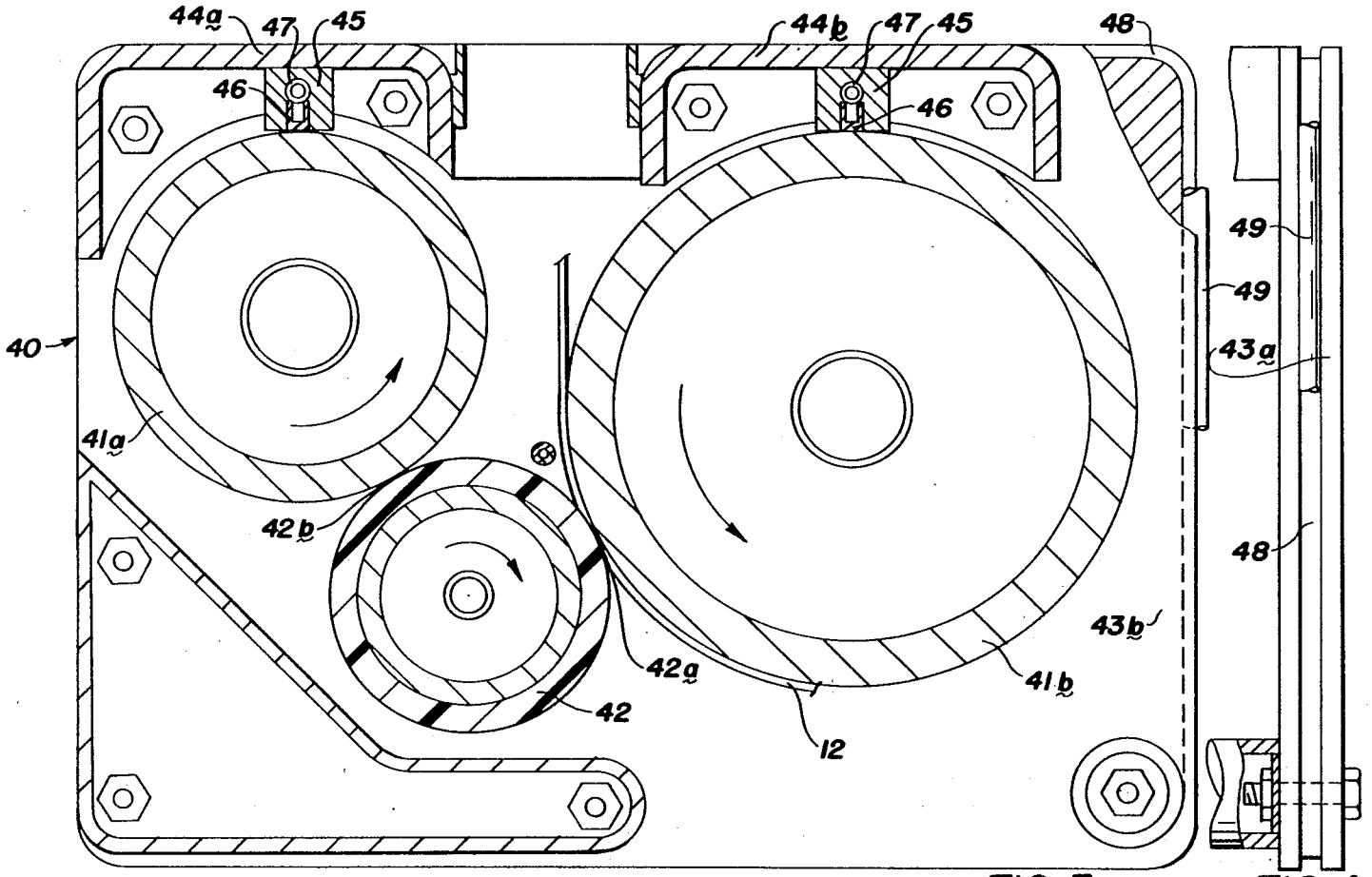
FIG. 3 is an enlarged cross sectional view illustrating an arrangement of rollers to provide a seal between the preparation zone and the treatment zone.
FIG. 4 is a cross sectional view taken along line 4—4 of FIG. 3.

As best illustrated in FIG. 3 of the drawing, each seal roll unit 15 and 40 comprises a pair of hard rollers 41*a* and 41*b* and a resilient roller 42 urged into pressure indented relation with each of the rollers 41*a* and 41*b* to form a pair of nips 42*a* and 42*b*. Rollers 41*a*, 41*b* and 42 are rotatably secured between spaced end plates 43*a* and 43*b*.

Seal supports 44*a* and 44*b* extend generally parallel to the axes of rollers 41*a* and 41*b*, as illustrated in FIG. 3 of the drawing, and support seal holders 45 having slots formed therein in which seal member 46 and inflatable tube 47 are movably secured. Tube 47 is connected through a suitable air line (not shown) to a source of pressurized fluid. Pressure in tubes 47 urge seal members 46 in a direction generally radial toward the surfaces of rollers 41*a* and 41*b* for forming an airtight seal therebetween. Seal members 46 and seals (not shown) between the ends of rollers 41*a*, 41*b* and 42 and end plates 43*a* and 43*b*, respectively, are similar to structure disclosed in Minton U.S. Pat. No. 1,633,121, the disclosure of which is incorporated herein by reference.

As shown in FIG. 4 of the drawing, each of the end plates 43*a* and 43*b* has a groove 48 formed in the periphery thereof and an inflatable tube 49 is positioned in the groove for providing a seal between end plates 43*a* and 43*b* and the housing in which the unit is installed.

As diagrammatically illustrated in FIG. 1 of the drawing, rollers 41*a* and 41*b* are driven by sprockets 41*c* and 41*d*, respectively, which are connected by a chain 41*e*. Rollers 41*a* and 41*b* thus rotate in unison and are preferably driven by an electric motor (not shown).

The outfeed metering seal roll unit 70 is similar to seal units 15 and 40 except that rollers 41*a*', 41*b*' and 42' are located in slightly different positions and seal holders 45' have been relocated to accommodate the geometry of the system.

As best illustrated in FIG. 2 of the drawing, seal unit 40 is mounted in a housing 50 having a bottom and side walls arranged to form a reservoir 52 for liquid. The vacuum zone 25 through modular units 20 and 22 is divided from treatment zone 35, as diagrammatically illustrated in FIG. 5 by roller seal unit 40. Thus, when air is evacuated from vacuum zone 25, zone 54 in housing 50 will be in communication with vacuum chamber 25 while the reservoir 52 is in communication with treatment zone 35. As best illustrated in FIG. 1 of the drawing, a pump 56 is mounted for drawing liquid through line 58 and valve 56*a* from holding tanks 38*a* and 38*b* and depositing the liquid in reservoir 52 until the lower portion of treatment zone 35 is completely filled with liquid and the liquid level 68 arises above the rollers 62 and 64 in squeeze unit 60 as will be hereinafter more fully explained.

SQUEEZE UNIT

The squeeze unit 60 preferably comprises a hard roller 62 and a resilient roller 64 urged into pressure indented relation to form a nip 65 therebetween. Rollers 62 and 64 are mounted in a generally rectangular shaped housing having front walls and end walls similar to those of modular units 20 and 22. Partitions 26' and 27' form a sealed vacuum zone 25' communicating with the ends of vacuum zones 35 in modular units 20 and 22. A treatment zone 35' is formed between partition 27' and the rear wall 23*b*' of the squeeze unit 60 and communicates with treatment zones 35 in modular units 20 and 22. Pressure adjustment mechanism (not shown) is provided for moving one or both of the rollers 62 and 64 for separating the surfaces thereof at nip 65 for positioning web 12 through nip 65 and for adjusting pressure exerted by rollers 62 and 64 on the web as the web is moved through nip 65.

OPERATION

Figure 5:
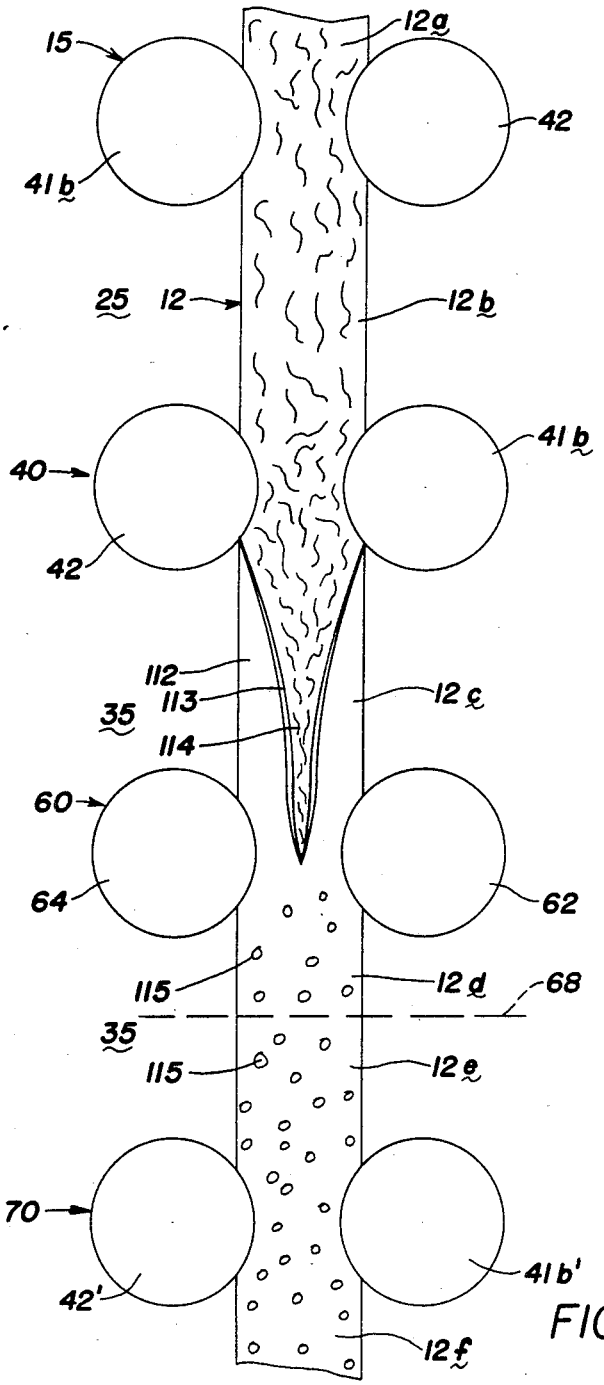
FIG. 5 is a schematic cross sectional view diagrammatically illustrating steps of a method of saturating a web.

The operation of the apparatus hereinbefore described permits sequential treatment of a web 12 as diagrammatically illustrated in FIG. 5, as it is moved through a chamber in the housing divided into a vacuum zone 25 and a treatment zone 35.

From the foregoing, it should be readily apparent that web 12 passes around roller 41*b* of the infeed vacuum seal roll unit 15 and is squeezed between hard roller 41*b* and resilient roller 42 for squeezing some of the air from the open area between the fibers in the web. Portion 12*b* of the web in the vacuum zone 25 of a chamber in the saturator is subjected to reduced pressure to draw additional air from the open area between the fibers in the web. As portion 12*b* of the web moves through the nip 42*a* between rollers 41*b* and 42 of outfeed seal roll unit 40, additional air is squeezed from the web. As the web leaves nip 42*a* it is moved through liquid in reservoir 52 which is pressurized to a predetermined pressure by delivering air through air lines 39*a* and 39*b* above the liquid level 68 of a column of liquid extending from reservoir 52 through squeeze unit 60.

The pressure in vacuum zone 25 is preferably reduced about 15 pounds per square inch less than atmospheric pressure and the pressure in treatment zone 35 is preferably approximately 15 pounds per square inch greater than atmospheric pressure. Thus, the pressure differential between vacuum zone 25 and treatment zone 35 is approximately 30 pounds per square inch such that liquid in reservoir 52 and the lower portion of treatment zone 35 is forced into the open area between the fibers in portion 12*c* of the web, the the open area between the fibers in the web having been evacuated at nip 42*a* of seal unit 15, in vacuum zone 25 and at nip 42*a* of outfeed seal unit 40.

As portion 12*c* of web 12 moves through nip 65, between rollers 62 and 64 of the squeeze unit 60, liquid is squeezed from the the open area between the fibers in the web carrying out any residual air which may have been occluded in the open area between the fibers and around fibers in the web. Since squeeze rollers 62 and 64 are submerged in liquid, the portion 12*e* of the web readily absorbs liquid as it moves out of nip 65 in the pressurized treatment zone 35.

As shown in FIG. 5, a surface layer 112 of fibers in portion 12*c* of the web initially absorbs liquid. However, a boundary 113 is formed leaving a dry core 114 of fibers. Rollers 62 and 64 break up and disburse bubbles in the core 114 and move the air and liquid in the core 114. Only very small disbursed bubbles 115 remain in the web which is impregnated and saturated with the liquid.

Resilient roller 42' of the outfeed metering seal roll unit 70 squeezes excess coating material from the surface of the web while forming a seal between the pressurized treatment zone 35 of the chamber in the paper saturator and atmospheric pressure outside of the chamber.

From the foregoing, it should be readily apparent that the web saturator 10 hereinbefore described may be employed separately or in line with a variety of equipment such as paper making machines or printing presses. Portion 12*f* of web may be routed through a dryer before delivery to a rewind stand or to additional equipment for performing additional functions on the web.

Having described my invention, I claim:

1. Apparatus to saturate a fibrous web with coating material comprising: a chamber having an inlet and an outlet; seal means adjacent each of said inlet and outlet, said seal means being adapted to permit passage of a web into and out of the chamber; a second seal means in said chamber dividing the chamber into a preparation zone and a treatment zone, the improvement comprising: means associated with said preparation zone for evacuating air from the open area between the fibers in the web; means in said treatment zone for containing pressurized liquid; pressure control means to maintain pressure in the treatment zone greater than atmospheric pressure; means in said treatment zone forming a nip; and means for submerging said nip in said pressurized liquid in said treatment zone to compress said web to squeeze liquid and residual air from the open area between the fibers in the web adjacent the entrance into the nip, thereby causing liquid to be drawn into the open areas between the fibers in the web upon exiting said nip.

2. Apparatus to saturate a fibrous web according to claim 1, said seal means adjacent the inlet comprising means forming a nip to squeeze air out of the open area between the fibers in a web passing through the nip and prior to entry of the web into the preparation zone.

3. Apparatus to saturate a fibrous web according to claim 2, said means associated with the preparation zone for evacuating air from the open area between the fibers in the web comprising means for forming a partial vacuum in said preparation zone.

4. Apparatus to saturate a fibrous web according to claim 3, said means in the treatment zone forming a nip comprising a pair of rollers, one of said rollers having a hard surface and the other a resilient surface for squeezing liquid and residual air from the web.

5. A method of saturating a fibrous web with coating material comprising the steps of: squeezing a web between a pair of rollers adjacent an entrance into a vacuum chamber; subjecting the web which has been squeezed between the pair of rollers to a partial vacuum in the vacuum chamber to draw air from the open area between the fibers in the web; squeezing the web between a second pair of rollers to form a seal to maintain the partial vacuum in the vacuum chamber; moving the web from the vacuum chamber through a reservoir of pressurized liquid to cause liquid to be drawn into the open area between the fibers in the web; and moving the web between a third pair of rollers submerged in the pressurized liquid to squeeze liquid and residual air from the open area between the fibers in the web to condition the web to become saturated with liquid in which the third pair of rollers is submerged.

* * * * *